United States Patent [19]

Doyle

[11] Patent Number: 4,651,453

[45] Date of Patent: Mar. 24, 1987

[54] TRAVEL IRON HAVING CONTROLLED HEAT AND COMPACT STORAGE

[75] Inventor: Edward J. Doyle, Hatboro, Pa.

[73] Assignee: Conair Corporation, Edison, N.J.

[21] Appl. No.: 798,950

[22] Filed: Nov. 18, 1985

[51] Int. Cl.[4] ..... D06F 75/24; D06F 75/34; D06F 75/38

[52] U.S. Cl. ..... 38/77.8; 38/82; 38/92; 38/93; 219/272; 219/504

[58] Field of Search ..... 219/504, 505, 544, 275, 219/328, 222, 245, 250, 251, 253, 254; 338/22 R; 38/93, 92, 77.9, 82, 77.7, 77.8, 77.4, 85; 99/425

[56] References Cited

U.S. PATENT DOCUMENTS

| | | | |
|---|---|---|---|
| 3,450,860 | 6/1969 | Kneisley | 219/272 X |
| 3,561,144 | 2/1971 | Pichl | 38/92 |
| 3,892,945 | 7/1975 | Lerner | 219/272 X |
| 4,081,660 | 3/1978 | Uffer et al. | 219/504 |
| 4,097,718 | 6/1978 | Weise | 219/222 |
| 4,196,340 | 4/1980 | Evans, Jr. et al. | 38/93 |
| 4,230,935 | 10/1980 | Meixner | 219/328 X |
| 4,233,763 | 11/1980 | McMullen | 38/93 |
| 4,512,250 | 4/1985 | Schindler et al. | 99/425 |
| 4,523,079 | 6/1985 | Albinger, Jr. | 219/254 X |

FOREIGN PATENT DOCUMENTS

| | | | |
|---|---|---|---|
| 214638 | 10/1984 | Fed. Rep. of Germany | 38/93 |

*Primary Examiner*—Werner H. Schroeder
*Assistant Examiner*—Andrew M. Falik
*Attorney, Agent, or Firm*—Haynes N. Johnson

[57] ABSTRACT

A travel iron with a plastic housing defining a hot water reservoir, with a plastic sole plate as its lower surface. An immersible PTC resistor is used to heat the water and to protect the iron from overheating. The heated water heats the sole plate and serves to control the temperature of the sole plate. The handle is reversible and is secured to the forward end of the housing. When reversed the handle provides a winding area about which the electrical cord may be wound for storage.

12 Claims, 5 Drawing Figures

TRAVEL IRON HAVING CONTROLLED HEAT AND COMPACT STORAGE

FIELD OF THE INVENTION

This invention relates to the field of compact, lightweight travel irons, and, in particular, to those made of plastic materials.

BACKGROUND OF THE INVENTION

In recent years travel irons have been made of all plastic, except for electrical components, and have included a water-containing reservoir containing a heater for the generation of steam.

The heater has usually been a pair of separated electrodes placed within the water; and the water may contain an electrolyte such as salt to aid in heating. Examples of these designs are found in Osrow U.S. Pats. Nos. 3,755,649 and 3,969,607. However, these electrodes often quickly corrode and cause problems of arcing and mineral buildup, so much so that efforts have been made to solve the resulting problems. See, for example, Santiago U.S. Pat. No. 4,190 762. Also, some of them are only operative in the normal horizontal position, and are unable to operate when used vertically.

Structures for the control of temperature have usually involved thermostats. Though some steamers, but not irons, have included reservoirs to hold heated water, they have not been used in irons to heat and limit the temperature of the sole plate. See, for instance, Mazzucco U.S. Pat. No. 4,366,367 and Osrow U.S. Pat. No. 4,206,340.

In addition, not all such irons have been made for ready, compact storage.

SUMMARY OF THE DISCLOSURE

The present invention has a plastic housing defining a water reservoir with a sole plate, normally made of plastic, forming the lower surface of the reservoir. This results in the sole plate being heated primarily by the heated water in the reservoir. The highest temperature of the sole plate is, then, limited to that of boiling water. The sole plate may also includes steam outlets which are connected by a passageway within the housing to a steam inlet (at a level above the normal level of the water in the reservoir).

Rather than using electrodes to provide heat, an immersible PTC resistance heater assembly is used. As is known, the resistance of such a heater rises sharply when it reaches a known pre-determined temperature (the Curie point). This rise in resistance effectively serves to cut off flow of electricity until the unit cools, and, so, acts as a protective circuit in case the reservoir runs out of water.

The iron is made more compact, and more readily stowable, by having a detachable and reversible handle. The handle is removably and reversibly secured to the housing at the forward end of the housing. Each end of the handle has a downwardly extending portion; and the forward portion is secured to the housing. When stowing the iron, the handle is removed and reversed (turned upside down). This serves not only to make the entire unit more compact, but also provides a place about which the electrical cord may be wound for storage.

BRIEF DESCRIPTION OF THE DRAWINGS

Turning to the drawings.

DETAILED DESCRIPTION OF THE INVENTION

Figure 1:
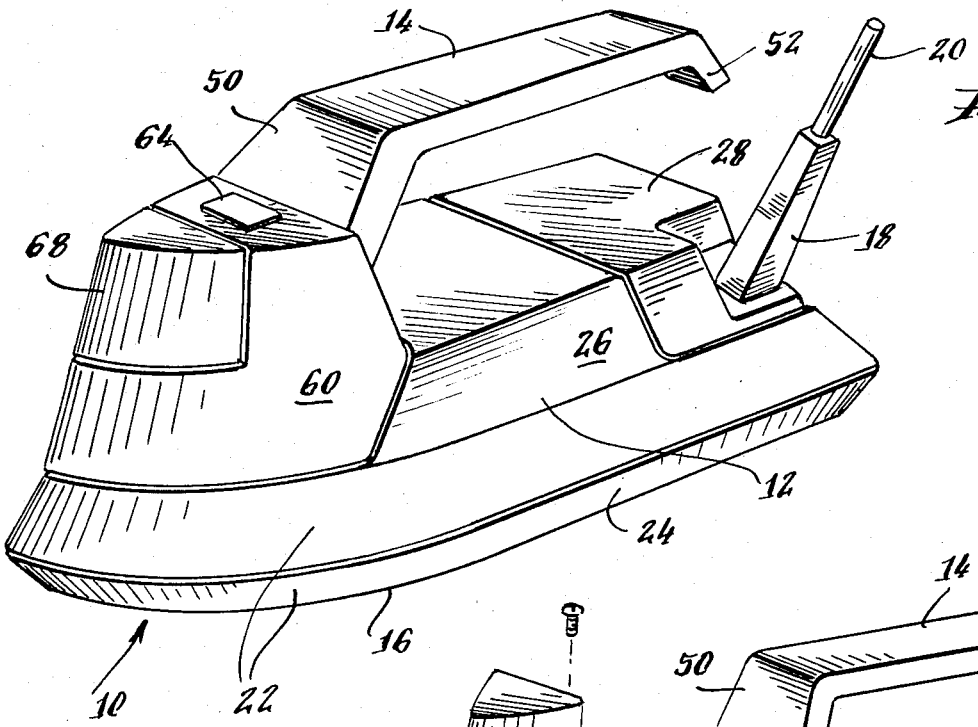
FIG. 1 is a perspective view of the iron of my invention.
Figure 2:
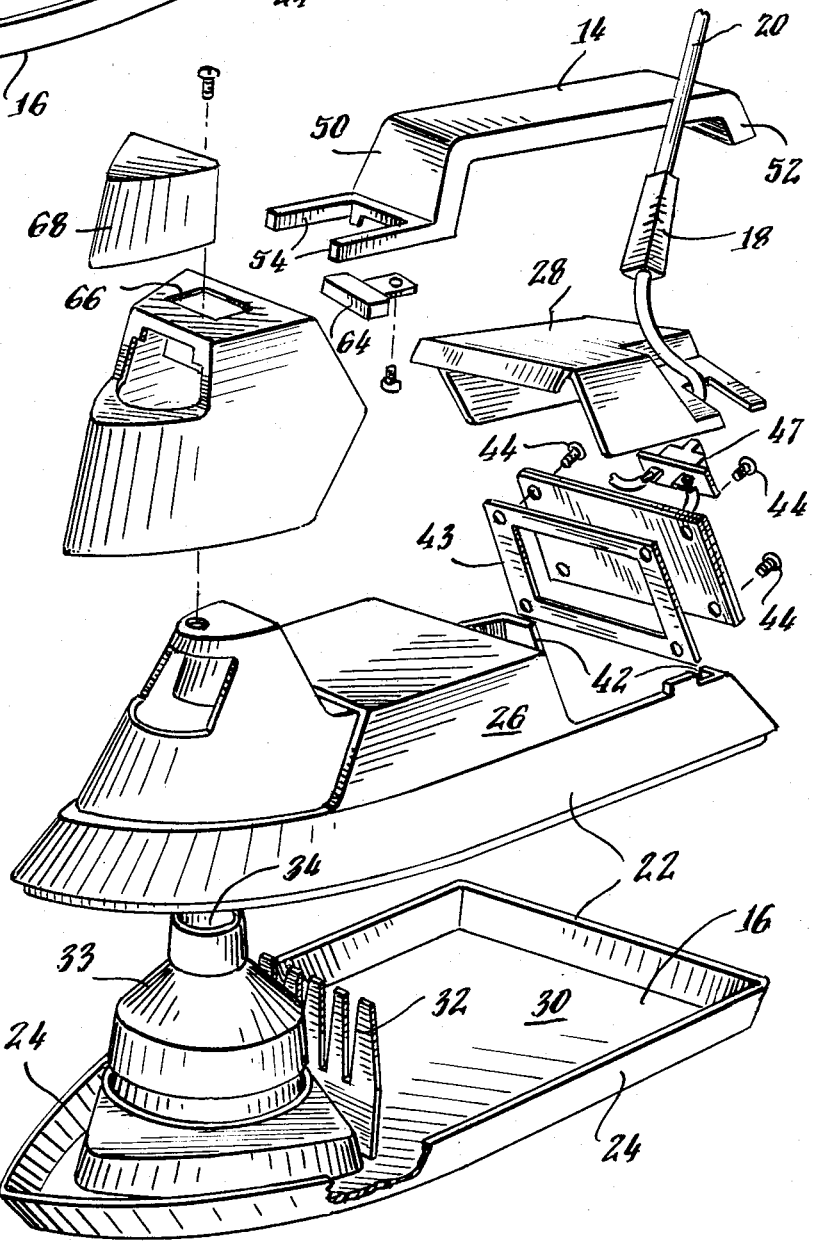
FIG. 2 is an exploded view of the drawing of FIG. 1.

A perspective view of my travel iron 10 is shown in FIG. 1. It includes a housing 12 made up of a lower housing 22 and an upper housing 26. It has a handle 14, a flat sole plate 16 (seen in FIG. 3), a removable and reversible handle 14, an electric cord inlet 18, and the cord itself 20.

Lower housing 22 includes the flat sole plate 16 and peripheral upwardly extending flanges 24. Flanges 24 fit the lower edges of upper housing 26 and are secured to it, preferably by ultrasonic welding.

Figures 3, 4, 5:
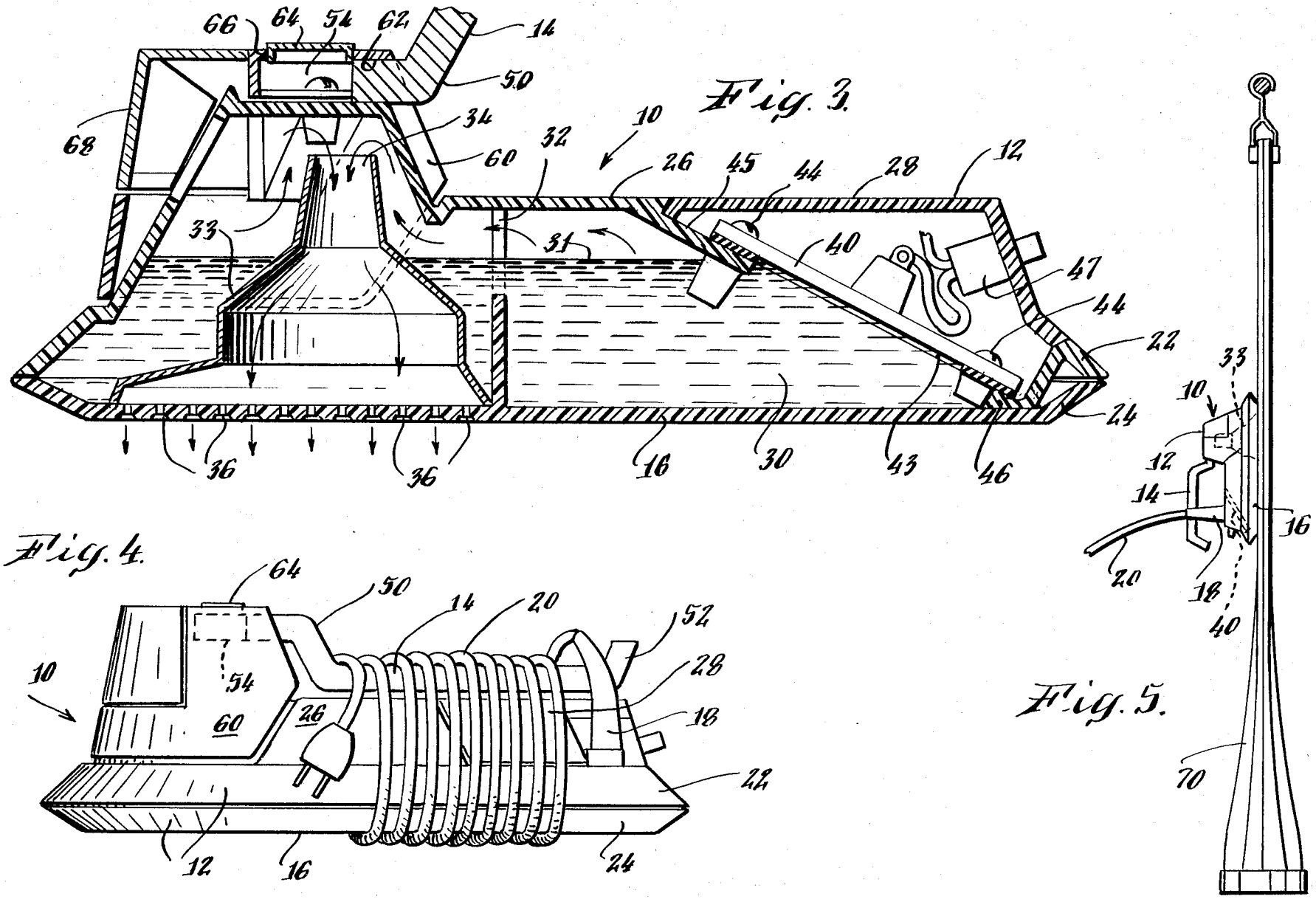
FIG. 3 is a longitudinal sectional view of the iron, showing the internal structure.
FIG. 4 is a side elevation of the iron with the handle in the storage position and the electrical cord wrapped around the unit.
FIG. 5 is a side elevational view showing the iron being used in its vertical position to press clothes hanging on a rack.

The lower housing 22, including sole plate 16 and its upwardly extending flanges 16, define the lower portion of water reservoir 30. The full reservoir is defined by this and upper housing 26 including its rearward section 28. It will hold water when the iron is in either the horizontal or vertical position. The water level 31 in the reservoir 30, when horizontal, is shown in FIG. 3. If desired, a baffle plate 32 may be installed vertically in reservoir 30 to prevent sloshing of water.

As can be seen, water within the reservoir rests on the inner surface of sole plate 16. Consequently, the heat from this water passes through and serves to heat the sole plate and is the principal heat source for the iron. The sole plate 16 may be made of any material that will transmit, and can withstand, the temperature of boiling water, but, preferably is made of plastic. The plastic used should be of a type, such as polycarbonate, capable of transmitting sufficient heat to permit use of the unit as an iron and of withstanding the temperature of boiling water.

Since the sole plate 16 is heated by water, temperature control of the sole plate is achieved, i.e., it cannot exceed the temperature of boiling water.

The forward end of sole plate 16 contains a series of steam outlets 36. These lead into a generally conical steam passageway 33, the upper end of which is a steam inlet 34. As can be seen the inlet 34 is higher than the normal water level in reservoir 30.

The heating element used to heat the water and to create steam is an immersible PTC resistor assembly 40, which is preferably of rectangular shape. Assembly 40 includes a PTC element enclosed within metal components, the metal permitting the transfer of heat from the PTC resistor to the water, but also isolating the resistor from the water, making the resistor immersible. PTC assembly 40 is secured to mounting frame 43 and to flanges 45 and 46 by mounting screws 44 and is connected to a power source through electrical connection 47, cord inlet 18, and cord 20. Resistor assembly 40 fits within holding slots 42 at the rear of housing 26. As best seen in FIG. 3, PTC resistor assembly 40 is positioned at an angle of about 30° to the horizontal. This assures that it will be submerged in water whether the iron is held horizontally or vertically.

A PCT resistor is a heating device which provides resistive heat (resulting from current flow) as long as it is below a pre-determined temperature known as the Curie point. Above that temperature, its resistance rises sharply and so limits current flow to almost zero. As a result, it can be used for safety (thermostatic) purposes as well as temperature control. In the present cast, a resistor is used with a Curie point sufficiently high to convert water to steam, but low enough to turn the iron off when it runs low on wter. In this instance, the PTC resistor should have a Curie point above the boiling point of water and below the fusing temperature of the plastic material used in making the iron. Preferably, it should be sufficiently below the fusing point to also prevent excessive overheating of the iron.

Once the resistor is in place, rear section 28 of upper housing 26 is installed, preferably by ultrasonic welding, making reservoir 30 watertight.

Handle 14 has a downwardly extending portion 50 at its forward end and a similar downwardly extending portion 52 at its after end. Latching engagement arms 54 project forwardly from the lower end of portion 50 and include a resilient latch 64 mounted between them.

An outer shell 60 fits about the forward end of upper housing 26 and is secured to it. Shell 54 includes an opening 62 (FIG. 3) at its after end to receive arms 54 and latch 64. It also includes latch-engaging opening 66 at the top to engage and hold latch 64. Latch 64 is designed so as to releasably engage with opening 66 when handle 14 is in its normal position and also when it is upside down. Consequently, for stowage, the handle may be reversed, reducing the overall size of the iron. In addition, when handle 14 is reversed, after portion 52 points upwardly and so provides a convenient place in which to coil electric cord 20 (FIG. 4).

The forward end of outer shell 60 includes a removable, snap-in filler door 68. By removing the door, one may add water to the reservoir 38, the water entering just forward of conical passageway 33.

In operation, the iron is assembled with its handle in the upper position; and the iron is filled with water and plunged in. PTC resistor assembly 40 heats the water in reservoir 38, and the water then heats sole plate 16. Excess steam passes through inlet 34, passageway 33, and out steam outlets 36. As can be seen from the angular position of PTC resistor 40, water will be heated whether the iron is in a horizontal or vertical position.

When a substantial part of the water has been boiled off, resistor assembly 40 will go "off", and so prevent the system from overheating. Upon refilling the iron, the assembly 40 will again go "On" and heat the water.

FIG. 5 shows the iron being used vertically to press a pair of pants 70 hanging on a hanger. It can be seen that the PTCR 40, because of its angular position in the reservoir, can still heat the water. In addition, steam can be emitted through conical passageway 33 and steam outlets 36.

When one wishes to store the unit, handle 14 is removed, reversed, and repositioned. This recesses handle 14 close to the upper surface of upper housing 26, with its rearward portion 52 pointing upwardly, providing a convenient place about which to coil electricl cord 20 (See FIG. 4).

I claim:

1. A lightweight travel iron adapted for controlled heat and for easy stowage including an enclosed plastic housing, said housing including a sole plate on the bottom thereof, said housing defining a water reservoir, said sold plate being made of a material which will withstand the temperature of boiling water and which is sufficiently heat conducting to pass heat from heated water in said reservoir through said sole plate to the outer surface thereof, an electrical heater mounted within said reservoir, said heater being a PTC resistor assembly, and an electric cord connected to said PTC resistor assembly for connecting said PTC resistor assembly to a source of electrical energy, and a handle secured to the top of said housing, whereby the temperature of the water in said reservoir will control the temperature of said sole plate.

2. A lightweight travel iron as set forth in claim 1 in which said sole plate is made of a plastic material capable of withstanding the temperature of boiling water and capable of transmitting sufficient heat therethrough to permit its use as an iron.

3. A lightweight travel iron including an enclosed plastic housing, said housing defining a sole plate on the bottom thereof and a water reservoir within said housing and on the inner surface of said sole plate, said sole plate including a steam outlet, said outlet being associated with a steam inlet within said housing and above the level of water in said reservoir, and a passageway interconnecting said inlet and said outlet, electrical steam generating means mounted within said reservoir, said steam generating means including a PTC resistor assembly, and means for connecting said PTC resistor assembly to a source of electrical energy, and said sole plate being sufficiently heat conductive to pass adequate heat from heated water in said reservoir to the outside of said sole plate for use as an iron, whereby water in said reservoir is heated and converted to steam, said PTC resistor assembly serves to prevent overheating of said iron, and the temperature of the water in said reservoir controls the temperature of said sole plate.

4. A travel iron adapted for compact sotrage and for safe operation, said iron including a plastic enclosed housing having a sole plate and a reservoir therein to contain water, electrical means for generating heat within said reservoir to create steam and an outlet for said steam in said sole plate, a handle removably mounted on the top of said housing, said handle having downwrdly extending portions at each end thereof, one of said portions being removably and reversibly secured to said housing, whereby said handle may be used to control said iron when in its normal position with the portions extending downwardly or, when reversed, used as place to wind an electrical cord for storage.

5. A travel steam iron as set forth in claim 4 including a latch for removably mounting said handle.

6. A travel steam iron as set forth in claim 4 in which said electrical steam generating means is a PTC resistor assembly.

7. A lightweight travel iron adapted for controlled heat and for easy stowage including an enclosed plastic housing, said housing including a sole plate on the bottom thereof, said housing defining a water reservoir, said sole plate being made of a material which will withstand the temperature of boiling water and which is sufficiently heat conducting to pass heat from heated water in said reservoir through said sole plate to the outer surface thereof, an electrical heater mounted within said reservoir, said heater being a PTC resistor assembly, and an electric cord connected to said PTC resistor assembly for connecting said PTC resistor to a source of electrical energy, a handle secured to the top of said housing, and said PTC heater being mounted at such an angle within said reservoir that it remains within water in said reservoir in both horizontal and vertical positions of said iron, whereby the temperature of the water in said reservoir will control the temperature of said sole plate.

8. A lightweight travel iron adapted for controlled heat and for easy stowage including an enclosed plastic housing, said housing including a sole plate on the bottom thereof, said housing defining a water reservoir, said sole plate being made of a material which will withstand the temperature of boiling water and which is sufficiently heat conducting to pass heat from a heated water in said reservoir through said sole plate to the outer surface thereof, an electrical heater mounted within said reservoir, said heater being a PTC resistor assembly, and an electric cord connected to said PTC resistor assembly for connecting said PTC resistor to a source of electrical energy, a handle secured to the top of said housing, and said PTC resistor having a Curie point above the boiling point of water and below the fusing temperature of said sole plate, whereby the temperature of the water in said reservoir will control the temperature of said sole plate.

9. A lightweight travel iron adapted for controlled heat and for easy stowage including an enclosed plastic housing, said housing including a sole plate on the bottom thereof, said housing defining a water reservoir, said sole plate being made of a material which will withstand the temperature of boiling water and which is sufficiently heat conducting to pass heat from heated water in said reservoir through said sole plate to the outer surface thereof, an electrical heater mounted within said reservoir, said heater being a PTC resistor assembly, and an electric cord connected to said PTC resistor assembly for connecting said PTC resistor to a source of electrical energy, a handle removably secured to the upper portion of said housing, and said handle being reversible to said upper housing portion and defining a coil storage winding area when in its reversed position.

10. A lightweight travel iron as set forth in claim 9 in which said handle includes downwardly extending portions at each end thereof when in its normal position and in which said portions define said winding area when said handle is in its reversed position.

11. A lightweight travel iron including an enclosed plastic housing, said housing defining a sole plate on the bottom thereof and a water reservoir within said housing and on the inner surface of said sole plate, said sole plate including a steam outlet, said outlet being associated with a steam inlet within said housing and above the level of water in said reservoir, and a passageway interconnecting said inlet and said outlet, electrical steam generating means mounted within said reservoir, said steam generating means including a PTC resistor assembly, and means for connecting said PTC resistor assembly to a source of electrical energy, said sole plate being sufficiently heat conductive to pass adequate heat from heated water in said reservoir to the outside of said sole plate for use as an iron, and said housing defining a reservoir when said iron is in either a horizontal or a vertical position, and said PTC resistor assembly being so positioned as to be within water in said reservoir in either of said positions, whereby water in said reservoir is heated and converted to steam, said PTC resistor assembly serves to prevent overheating of said iron, and the temperature of the water in said reservoir controls the temperature of said sole plate.

12. A steam iron as set forth in claim 11 in which said PTC resistor assembly is positioned at an angle of about 30° to the horizontal.

* * * * *